US007409817B1

(12) United States Patent
Huang

(10) Patent No.: US 7,409,817 B1
(45) Date of Patent: Aug. 12, 2008

(54) BICYCLE CHAIN SPLITTER

(76) Inventor: Hung-Chen Huang, No. 1-5, Guangfu Rd., Pitou Township, Changhua County 52344 (TW)

( * ) Notice: Subject to any disclaimer, the term of this patent is extended or adjusted under 35 U.S.C. 154(b) by 0 days.

(21) Appl. No.: 11/868,525

(22) Filed: Oct. 7, 2007

(51) Int. Cl.
*B25B 13/00* (2006.01)
*B21L 21/00* (2006.01)

(52) U.S. Cl. ..... 59/7; 59/11; 7/138; 29/243.53

(58) Field of Classification Search ..... 59/7, 59/11, 35.1; 7/138; 29/243.53
See application file for complete search history.

(56) References Cited

U.S. PATENT DOCUMENTS 2,783,611 A * 3/1957 Simpkin et al. ..... 59/7
2,826,893 A * 3/1958 Morris et al. ..... 59/7
5,463,862 A * 11/1995 Reisenauer ..... 29/243.53
7,082,747 B2 * 8/2006 Oishi et al. ..... 59/11
7,254,935 B1 * 8/2007 Huang ..... 81/63.2

* cited by examiner

*Primary Examiner*—David B Jones
(74) *Attorney, Agent, or Firm*—Banger Shia

(57) ABSTRACT

A bicycle chain splitter comprises a splitter body, an actuating member and a guiding member. The splitter body includes a guiding hole and a through hole that are aligned with each other. Between the guiding hole and the through hole is formed an assembly space for holding the chain. The actuating member is forced to move in the guiding hole of the splitter body. The guiding member is pre-inserted into the through hole of the splitter body and the assembly holes of the chain. The positioning pin is pushed by the actuating member into the assembly holes of the chain under the guidance of the guiding member.

3 Claims, 6 Drawing Sheets

BICYCLE CHAIN SPLITTER

BACKGROUND OF THE INVENTION

1. Field of the Invention

The present invention relates to a bicycle chain splitter, and more particularly to a chain splitter that is adapted for disconnecting a bicycle chain.

2. Description of the Prior Art

Referring to FIG. 1, a conventional chain splitter comprises: a splitter body 11 and an actuating rod 12. One end of the assembly seat 11 is formed with a guiding hole 111. The guiding hole 111 is formed with inner threads 112. An assembly space 113 is defined in the middle of the splitter body 11, in the assembly space 113 is formed an engaging portion 114 for engaging with a chain A to be splitted. The splitter body 11 further includes a through hole 115 at the other end thereof, and the through hole 115 is aligned with the guiding hole 111. The actuating rod 12 is to be inserted into the guiding hole 111 of the splitter body 11, and the actuating rod 12 is formed with outer threads 121 in the external wall thereof for meshing with the inner threads 112 of the guiding hole 111. The actuating rod 12 is coaxially formed with a push rod 122 for pushing a positioning pin of the chain A. Further analysis of the above structure shows that the conventional device 10 has the following problems:

The method of connecting a chain A requires to align the assembly holes A1 to each other, then the positioning pin B can be inserted into the respective assembly holes A1. However, when two ends of a chain A are mounted on the engaging portion 114 of the assembly space 113, the user has to hold the chain A with one hand while rotating the actuating rod 12 with the other, so that it is difficult for him to align the assembly holes A1 to allow for insertion of the positioning pin B into the assembly holes A1 of two ends of the two chain A. In this case, if the positioning member B is misaligned and the push rod 122 keeps pushing it, it is likely to damage the chain A.

In order to solve the above problems, the inventor of the present invention has invented an improved chain splitter.

SUMMARY OF THE INVENTION

The primary objective of the present invention is to provide a bicycle chain splitter, which utilizes a guiding member to guide the insertion of the positioning pin into the chain.

In order to achieve the above objective, the bicycle chain splitter in accordance with the present invention comprises a splitter body, an actuating member and a guiding member. The splitter body includes a guiding hole and a through hole that are aligned with each other. The guiding hole is formed with inner threads. Between the guiding hole and the through hole is formed an assembly space with a positioning protrusion for positioning two ends of a chain. The actuating member is formed with outer threads and can move in the guiding hole of the splitter body for pushing the positioning pin into or out of the chain. The guiding member is pre-inserted into the through hole of the splitter body and the assembly holes of the chain, so that the positioning pin can be pushed by the actuating member into the assembly holes of the chain easily under the guidance of the guiding member without the possibility of misalignment, and the guiding member can be pushed out of the chain once the positioning pin is positioned in place. By such arrangements, the present invention not only makes it easier to assemble the positioning pin to the chain, but avoid damaging the chain caused by the misalignment of the positioning pin.

DETAILED DESCRIPTION OF THE PREFERRED EMBODIMENTS

Figure 1:
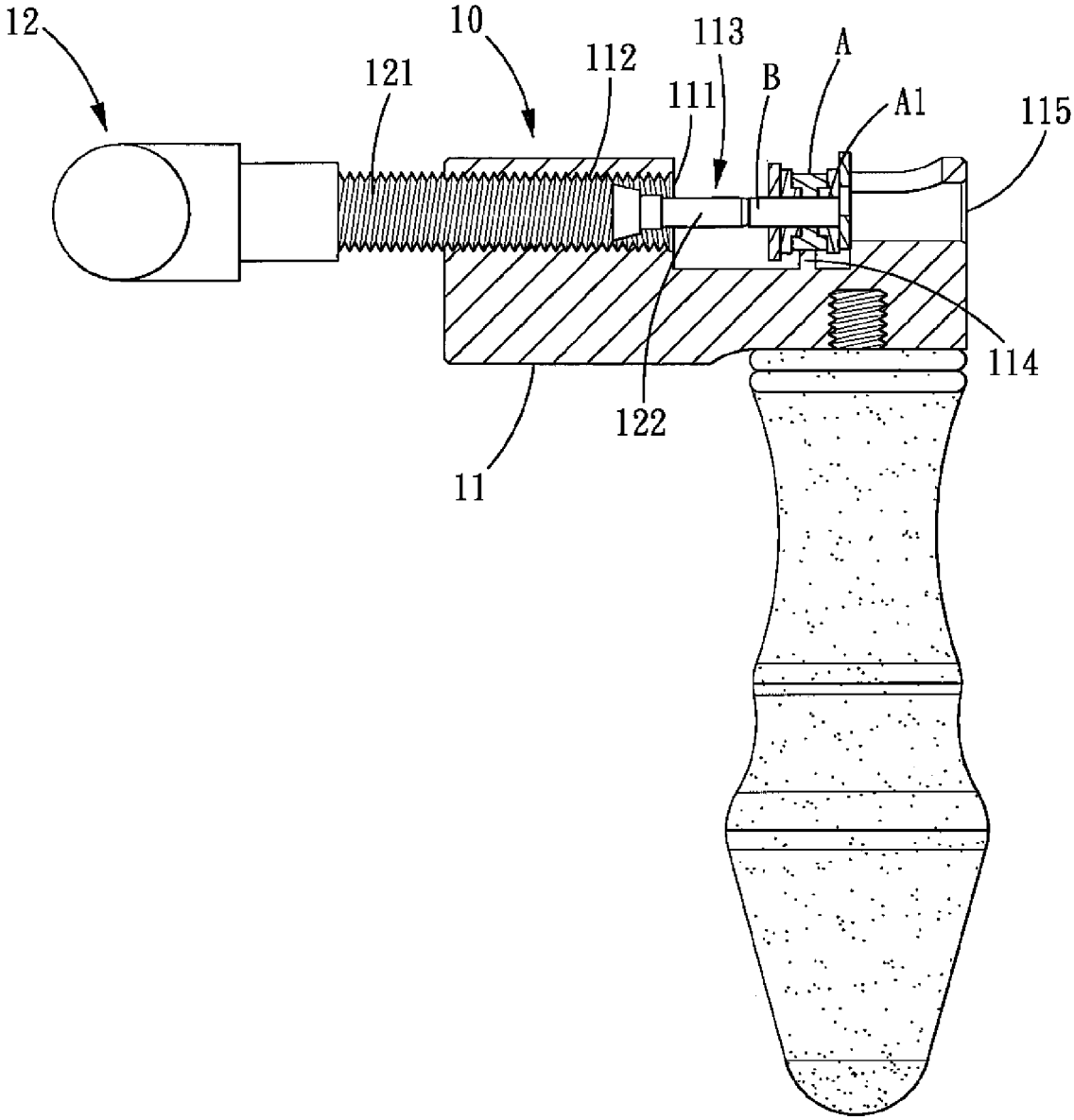
FIG. 1 PRIOR ART
FIG. 1 is an assembly view of a conventional bicycle chain splitter.
Figure 2:
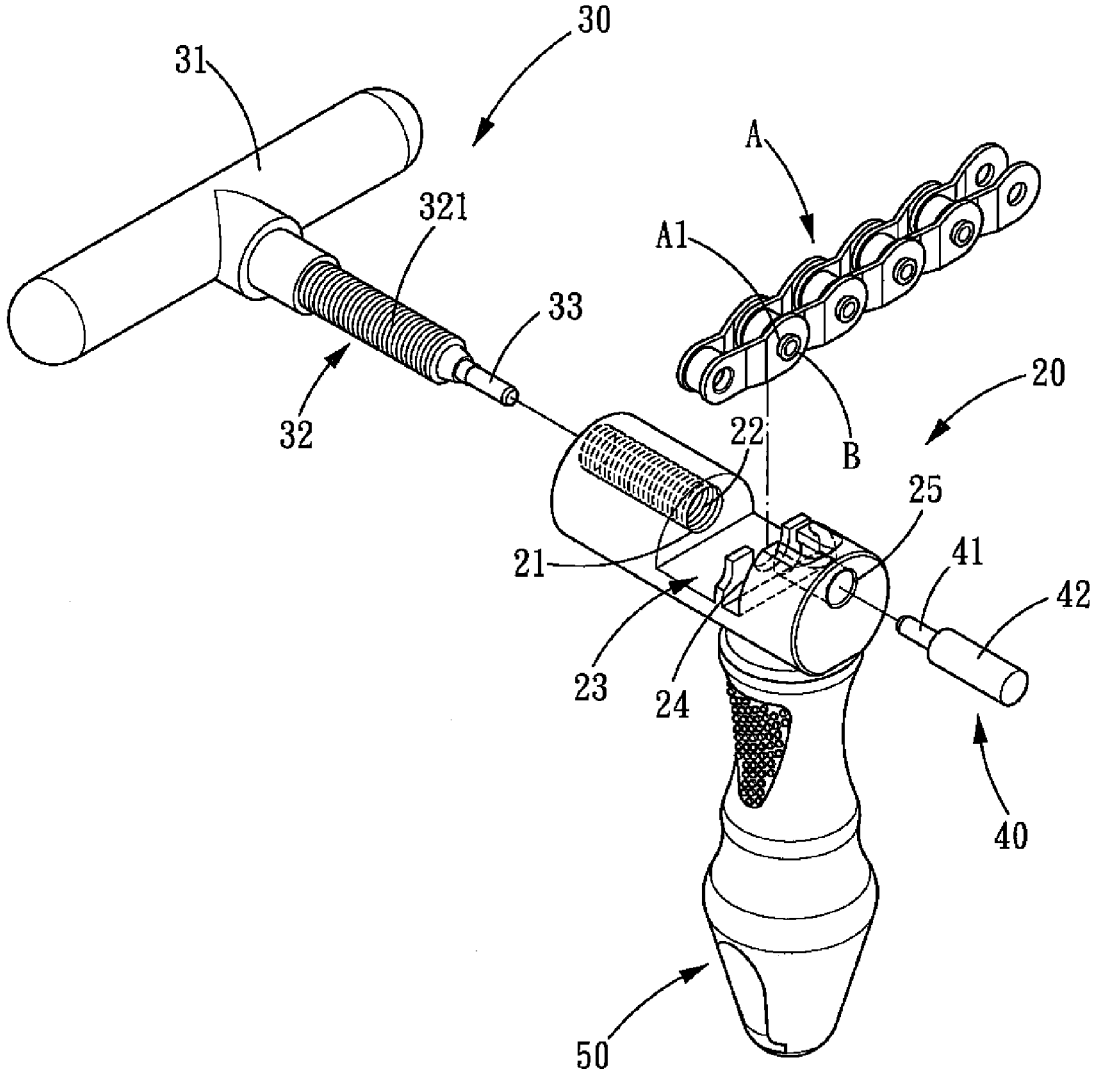
FIG. 2 is an exploded view of a bicycle chain splitter in accordance with the present invention.
Figure 3:
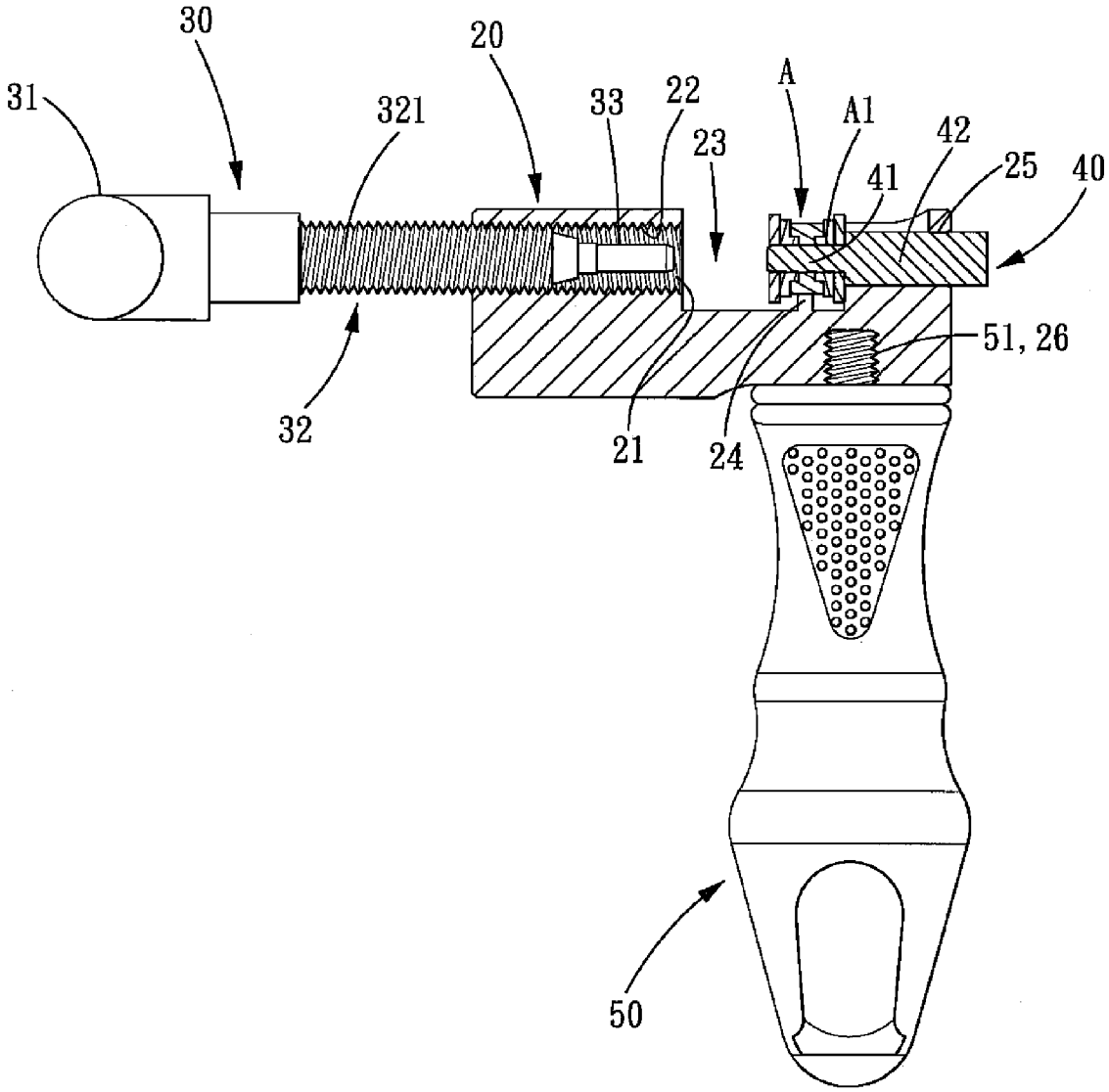
FIG. 3 is a first assembly view of the bicycle chain splitter in accordance with the present invention.

The present invention will be clearer from the following description when viewed together with the accompanying drawings, which show, for purpose of illustrations only, the preferred embodiment in accordance with the present invention.

Referring to FIGS. 2-5, a bicycle chain splitter in accordance with the present invention comprises a splitter body 20, an actuating member 30, a guiding member 40 and a handle 50.

The above bicycle chain splitter is suitable for use in the chain A with assembly holes A1 and positioning pins B.

The splitter body 20 is a column-shaped structure. One end of the splitter body 20 is axially formed with a guiding hole 21. The guiding hole 21 is formed with inner threads 22 in the internal wall thereof. In the middle of the splitter body 20 is formed an assembly space 23 with a positioning protrusion 24. The other end of the splitter body 20 is formed with a hollow through hole 25 aligned with the guiding hole 21. The splitter body 20 is formed with a connecting portion 26 under the through hole 25, and the connecting portion 26 of the splitter body 20 is a round hole with inner threads.

The actuating member 30 is a T-shaped structure with a force-bearing portion 31, a rotary portion 32 and a thrust portion 33. The force-bearing portion 31 is a column-shaped structure, and the rotary portion 32 is a column-shaped structure. The rotary portion 32 is vertically formed in the middle of the force-bearing portion 31. The external wall of the rotary portion 32 is formed with outer threads 321. The thrust portion 33 is a column-shaped structure and coaxially formed at one end of the rotary portion 32.

The guiding member 40 includes a first guiding portion 41 and a second guiding portion 42. Both the first guiding portion 41 and the second guiding portion 42 are column-shaped. The first guiding portion 41 is shaped correspondingly to the shape of the assembly hole A1 of a chain A, and the second guiding portion 42 is shaped correspondingly to the shape of the through hole 25 of the splitter body 20. The outer diameter of the first guiding portion 41 is smaller than that of the second guiding portion 42.

One end of the handle 50 is formed with a connecting portion 51 aligned with the connecting portion 26 of the splitter body 20. The connecting portion 51 of the handle 50 is column-shaped and formed with outer threads.

The aforementioned is the summary of the positional and structural relationship of the respective components of the preferred embodiment in accordance with the present invention.

Figure 4:
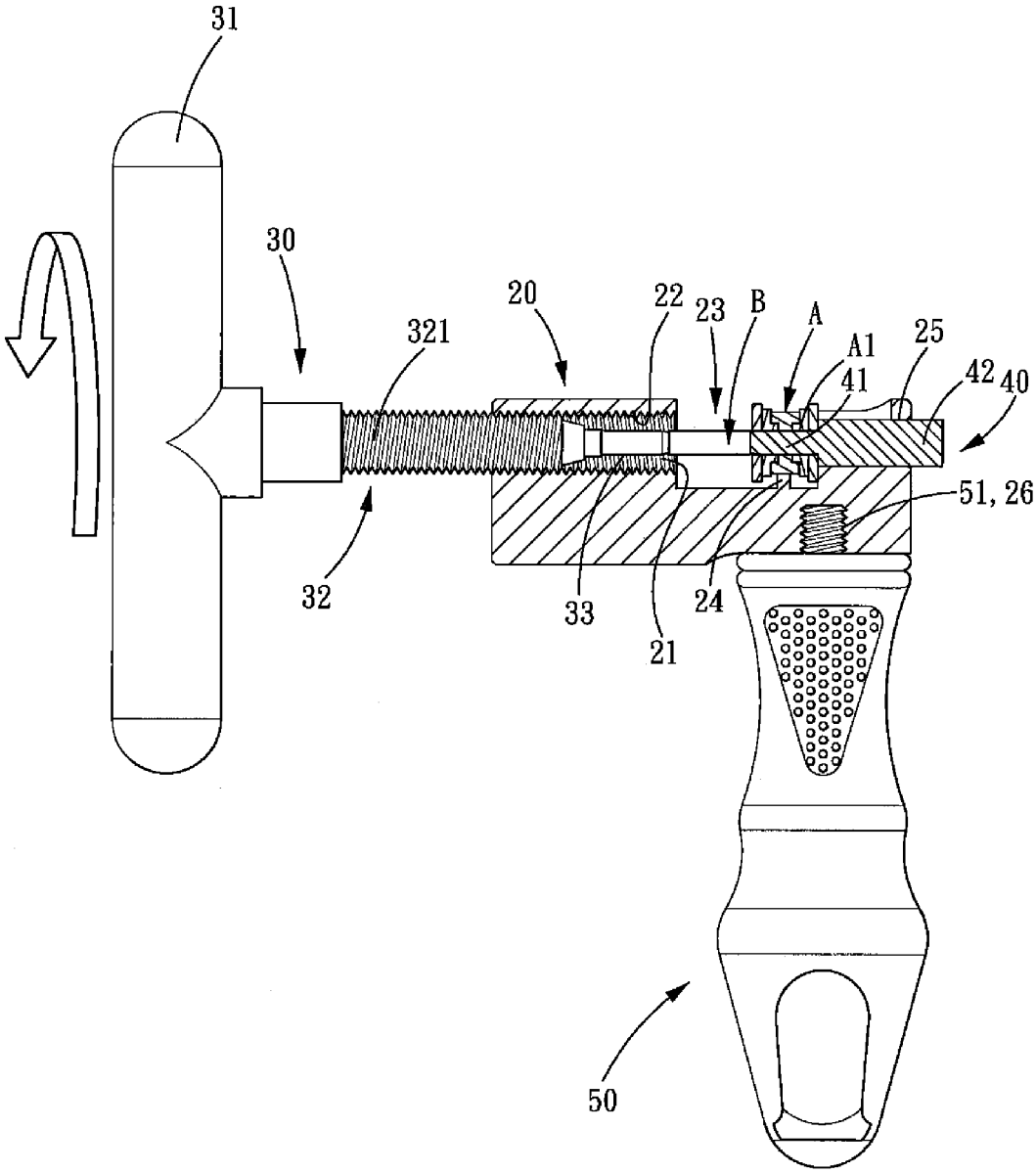
FIG. 4 is a second assembly view of the bicycle chain splitter in accordance with the present invention.
Figure 5:
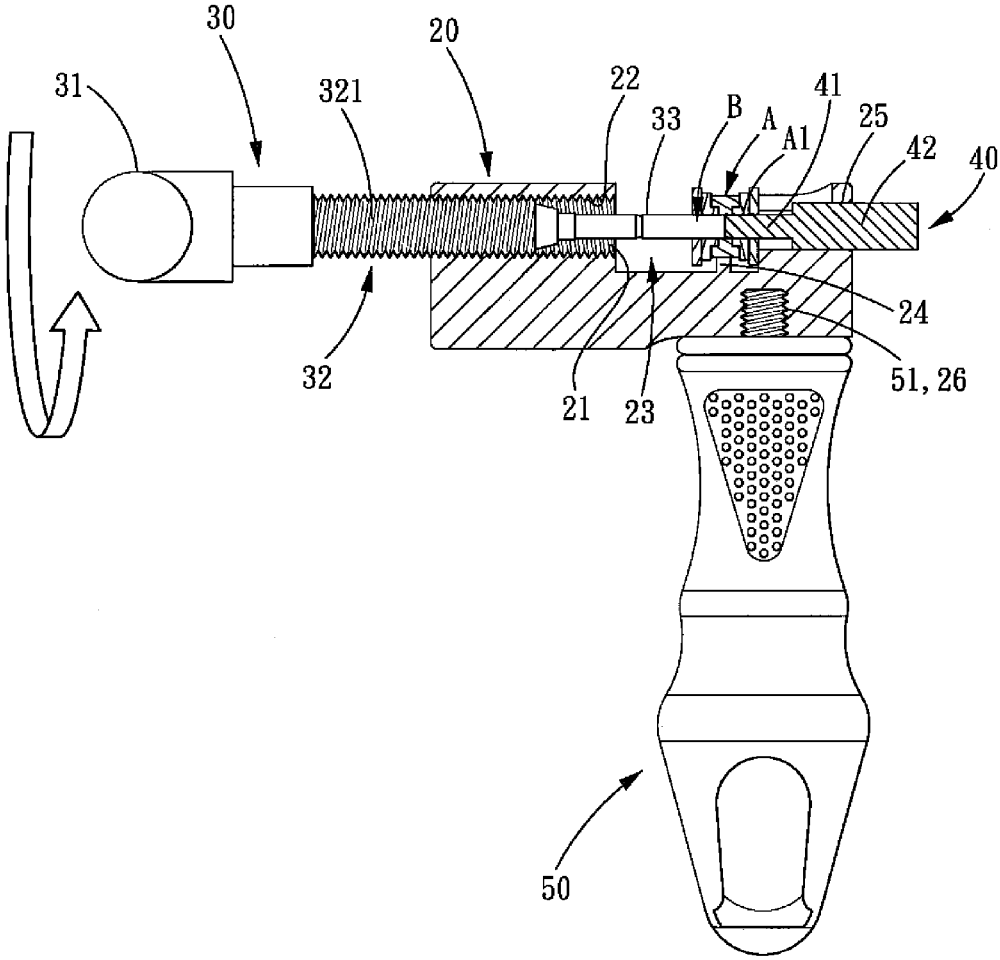
FIG. 5 is a third assembly view of the bicycle chain splitter in accordance with the present invention.
Figure 6:
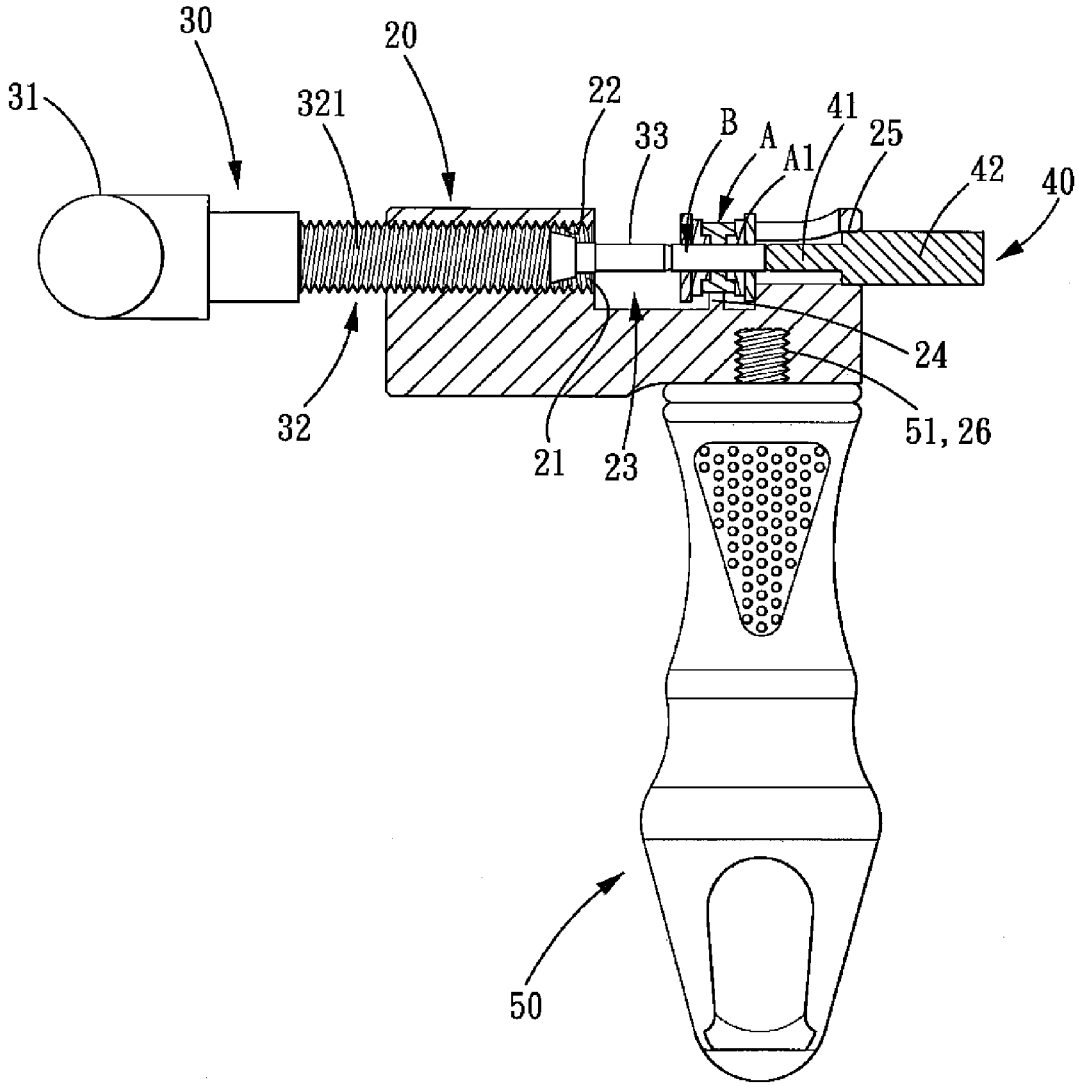
FIG. 6 is a fourth assembly view of the bicycle chain splitter in accordance with the present invention.

For a better understanding of the present invention, its operation and function, reference should be made to FIGS. 2-6:

The operation of splitting a chain by a chain splitter is of conventional technology, so further explanations are omitted here. Here, we are only discussing how to connect a chain by using the chain splitter in accordance with the present invention. Before the chain splitter is used, the handle 50 (please refer to FIG. 3) is locked to the splitter body 20 by screwing the connecting portion 51 into connecting portion 26. When the positioning pin B is to be inserted into the chain A, two ends of the chain A are positioned on the positioning protrusion 24 of the splitter body 20 first, and then the guiding member 40 is inserted into the through hole 25 of the splitter body 20, and subsequently, the first guiding portion 41 of the guiding member 40 is inserted through the assembly holes A1 of the two ends of the chain A. After that, the position pin B is placed between the guiding member 40 and the actuating member 30 in such a manner that both ends of the positioning pin B are abutted against the first guiding portion 41 of the guiding member 40 and the thrust portion 33 of the actuating member 30, respectively, so that the user can hold the handle 50 with one hand while rotating the actuating member 30 with the other hand (as shown in FIG. 4). With the rotation of the force-bearing portion 31 of the actuating member 30, the rotary portion 32 of the actuating member 30 can move forward along the guiding hole 21 of the splitter body 20. At this moment, the thrust portion 33 of the actuating member 30 (as shown in FIG. 5) pushes the positioning pin B to move, and then the positioning pin B is caused to push the guiding member 40 backward, thus making the first guiding portion 41 and the second guiding portion 42 of the guiding member 40 move out of the through hole 25 of the splitter body 26 (as shown in FIG. 6).

The guiding member 40 is pre-inserted into the respective assembly holes A1 of two ends of the chain A, so that the positioning pin B can be successfully pushed into the two chains A under the guidance of the guiding member 40. After the positioning pin B is positioned in place, the guiding member 40 is pushed out of the through hole 25 of the splitter body 26 automatically. By such arrangements, the present invention not only makes it easier to assemble the positioning pin B to the chain A, but avoid damaging the chain A caused by the misalignment of the positioning pin B.

To summarize, the chain splitter in accordance with the present invention comprises a splitter body, an actuating member and a guiding member. The splitter body includes a guiding hole and a through hole that are aligned with each other. Between the guiding hole and the through hole is formed an assembly space for holding the chain. The actuating member is forced to move in the guiding hole of the splitter body, and the guiding member is pre-inserted into the through hole of the splitter body and the assembly holes of the chain, so that the positioning pin can be pushed by the actuating member into the assembly holes of the chain easily under the guidance of the guiding member without the possibility of misalignment, and the guiding member can be pushed out of the chain once the positioning pin is positioned in place.

While we have shown and described various embodiments in accordance with the present invention, it is clear to those skilled in the art that further embodiments may be made without departing from the scope of the present invention.

What is claimed is:

1. A bicycle chain splitter, comprising: a splitter body and an actuating member; wherein the splitter body includes a guiding hole and a through hole that are aligned with each other, the guiding hole is formed with inner threads, between the guiding hole and the through hole is formed an assembly space for holding a chain, the actuating member is formed with outer threads, the outer threads of the actuating member are engaged with the inner threads of the splitter body and moves in the guiding hole of the splitter body to disassemble and assemble a positioning pin and the chain, the chain splitter is characterized in that:

the chain splitter further comprises a guiding member, the guiding member is pre-inserted into the assembly holes of the chain and the through hole of the splitter body, thus allowing the positioning pin to be pushed by the actuating member into the assembly holes of the chain easily under the guidance of the guiding member, and the guiding member will be pushed out of the chain once the positioning pin is positioned in place.

2. The bicycle chain splitter as claimed in claim 1, wherein the guiding member includes a first guiding portion and a second guiding portion, the first guiding portion is inserted into the assembly holes of the chain, and the second guiding portion is inserted into the through hole of the splitter body.

3. The bicycle chain splitter as claimed in claim 2, wherein an outer diameter of the first guiding portion of the guiding member is smaller than that of the second guiding portion of the guiding member.

* * * * *